US008699938B2

(12) United States Patent
Mogi

(10) Patent No.: US 8,699,938 B2
(45) Date of Patent: Apr. 15, 2014

(54) IMAGE FORMING APPARATUS

(75) Inventor: Keisuke Mogi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/333,785

(22) Filed: Dec. 21, 2011

(65) Prior Publication Data

US 2012/0163838 A1 Jun. 28, 2012

(30) Foreign Application Priority Data

Dec. 28, 2010 (JP) ..... 2010-293016

(51) Int. Cl.
*G03G 15/00* (2006.01)

(52) U.S. Cl.
USPC ..... 399/400; 399/388; 271/176; 271/243; 271/245; 271/246

(58) Field of Classification Search
USPC ..... 399/388, 400; 271/176, 243, 245, 246, 271/258.01, 265.01
See application file for complete search history.

(56) References Cited

U.S. PATENT DOCUMENTS

| | | | | |
|---|---|---|---|---|
| 7,055,818 | B2 * | 6/2006 | Furusawa | 271/220 |
| 7,584,960 | B2 * | 9/2009 | Ha | 271/246 |
| 8,439,358 | B2 * | 5/2013 | Watanabe et al. | 271/243 |
| 2008/0253806 | A1 * | 10/2008 | Yoshino et al. | 399/171 |
| 2009/0102117 | A1 * | 4/2009 | Yu et al. | 271/226 |
| 2011/0089629 | A1 * | 4/2011 | Furusawa et al. | 271/227 |

FOREIGN PATENT DOCUMENTS

JP 6-175524 A 6/1994

* cited by examiner

*Primary Examiner* — Matthew G Marini
*Assistant Examiner* — Allister Primo
(74) *Attorney, Agent, or Firm* — Canada USA Inc. IP Division

(57) ABSTRACT

A sheet conveying apparatus includes: a rotating member configured to rotate by being pushed by a leading edge of a sheet being conveyed; a sensor configured to output a signal corresponding to a position of the rotating member; a first abutting portion provided on the rotating member and with which the leading edge of the sheet being conveyed comes into contact; and a second abutting portion provided on the rotating member on a side opposite from the first abutting portion with respect to a rotation shaft of the rotating member and configured to come into contact with the sheet being conveyed in the course of the rotation of the rotating member by being pushed by the leading edge of the sheet being conveyed.

8 Claims, 9 Drawing Sheets

IMAGE FORMING APPARATUS

BACKGROUND OF THE INVENTION

1. Field of the Invention

The present invention relates to an image forming apparatus configured to form images on sheets.

2. Description of the Related Art

In an electrophotographic image forming apparatus, a toner image transferred to a sheet is fixed to the sheet by a fixing apparatus. The fixing apparatus fixes the toner image on the sheet by applying heat to the sheet to fuse the toner image while conveying the sheet by a pair of fixing rotating bodies.

In the image forming apparatus, a sheet detecting mechanism configured to detect a sheet conveyance failure (jam) or the presence or absence of a remaining sheet stopped due to the conveyance failure is arranged. The sheet detecting mechanism includes a lever (rotating member) which rotates by being pushed by a sheet being conveyed and a photo sensor configured to detect the position of the lever. A detecting lever is configured to restore its waiting position, for example, by an urging force of a spring when not being pressed by the sheet any longer (Japanese Patent Laid-Open No. 6-175524). The lever of the sheet detecting mechanism may be configured to have a restriction in a movable range in the direction of rotation, which is caused when pushed by the sheet being conveyed, by means of a stopper which restricts the rotation of the lever in the direction of rotation caused when pushed by the sheet. The reason why the rotation of the lever is restricted by the stopper is that other devices should be prevented from becoming damaged by the lever rotating because of inertia by being pushed by the sheet being conveyed and hitting against the devices or for ensuring earlier restoration of the lever to its waiting position.

Here, there is a problem of an impact noise generated when the lever rotating because of the inertia by being pushed by the sheet being conveyed comes into abutment with the stopper.

SUMMARY OF THE INVENTION

The present invention provides an apparatus in which a noise generated when the rotation of a rotating member arranged in the interior of the apparatus is stopped is reduced while further ensuring an operation of the rotating member.

The present invention provides a sheet conveying apparatus including: a rotating member configured to rotate by being pushed by a leading edge of a sheet being conveyed; a sensor configured to output a signal corresponding to a position of the rotating member; a first abutting portion provided on the rotating member and with which the leading edge of the sheet being conveyed comes into contact; and a second abutting portion provided on the rotating member on a side opposite from the first abutting portion with respect to a rotation shaft of the rotating member and configured to come into contact with the sheet being conveyed in the course of the rotation of the rotating member by being pushed by the leading edge of the sheet being conveyed.

According to the invention, there is provided an apparatus in which a noise generated when the rotation of a rotating member is stopped is reduced.

Further features of the present invention will become apparent from the following description of exemplary embodiments with reference to the attached drawings.

DESCRIPTION OF THE EMBODIMENTS

Figure 1:
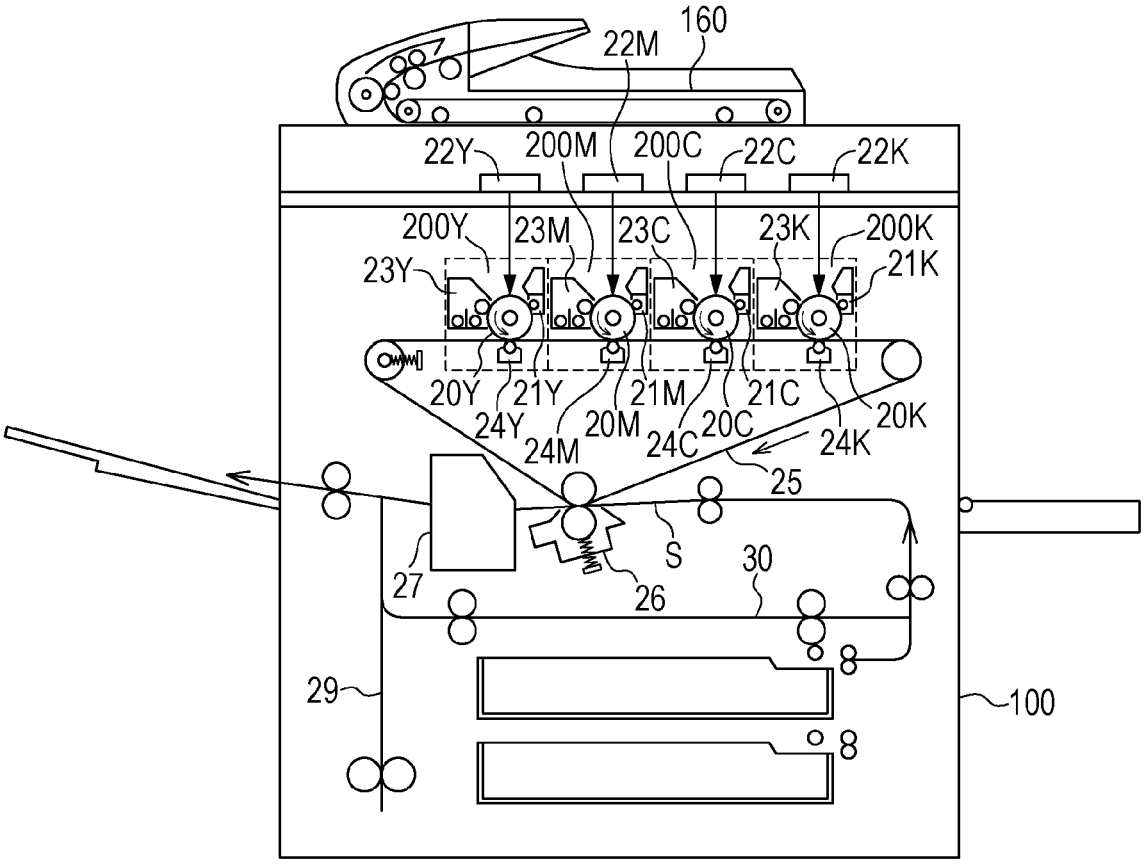
FIG. 1 is a cross-sectional view of an image forming apparatus according to an embodiment of the invention.

Referring now to the drawings, an embodiment of an image forming apparatus according to the invention will be described in detail.

FIG. 1 shows a configuration of an apparatus body 100 in the image forming apparatus, including a fixing apparatus configured to perform a permanent fixing process by applying heat and pressure to an unfixed image transferred to a sheet, that is, a recording material S. Although a mode of a full-color intermediate transferring system is exemplified as a detailed example of the image forming apparatus, the invention is not specifically limited thereto and may be applied to a monochrome image forming apparatus as well.

The apparatus body 100 includes image carriers 20Y, 20M, 20C, and 20K that carry electrostatic latent images on the surfaces thereof corresponding to toner images of four colors, for example, Y (yellow), M (magenta), C (cyan), and K (black). Hereinafter, the above-described four image carriers are denoted by a representative reference numeral 20, and a charging unit, an exposing unit, and a developing unit described later are also denoted by representative reference numerals for avoiding complex description.

The surfaces of the four image carriers 20 are uniformly charged at a predetermined potential by primary charging units 21, and then the surfaces of the image carriers 20 are exposed by exposing units 22, whereby the electrostatic latent images are formed on the image carriers 20. Then, the electrostatic latent images on the image carriers 20 are developed using developer by developing apparatuses 23, and are made visible as toner images.

As shown in FIG. 1, the apparatus body 100 employs a tandem system in which image forming portions 200Y, 200M, 200C, and 200K utilized for the formation of the above-described toner images of four colors are arranged in series and processes to be performed until the images are made visible are performed in parallel for each of the colors.

The toner images on the image carriers 20 developed by the developing apparatuses 23 are superimposed in sequence on an intermediate transfer member 25 made up of, for example, an endless belt, by primary transfer apparatuses 24, thereby a primary transfer is achieved. Then, a toner image on the intermediate transfer member 25, which is formed by the primary transfer of the toner images of all the colors, is transferred as a whole to the recording material S by a secondary transfer apparatus 26. The recording material S is conveyed to the secondary transfer apparatus 26 by a paper feeding unit. After a secondary transfer, the recording material S carrying unfixed toner images is conveyed to a fixing apparatus 27 as a belt-type fixing unit according to this embodiment, then heated and pressed by the fixing apparatus 27, so that the unfixed toner images are fused and softened and hence fixed. When the fixation is completed, the recording material S is output to a paper output tray 28. When forming an image on the back side of the recording material, the recording material is reversed by a recording material reversing path 29, and is then conveyed to a second transfer unit again via a duplex conveying path 30, where an image is formed on the back side thereof.

As described above, a series of image forming processes of charging, exposing, developing, transferring, and fixing are performed in this order and an image is formed on the recording material S. The monochrome image forming apparatus may have a configuration in which only an image forming portion for black exists. The configuration or the order of arrangement of the image forming portions for respective colors Y, M, C, and K are not limited to the embodiment described above.

Figure 2:
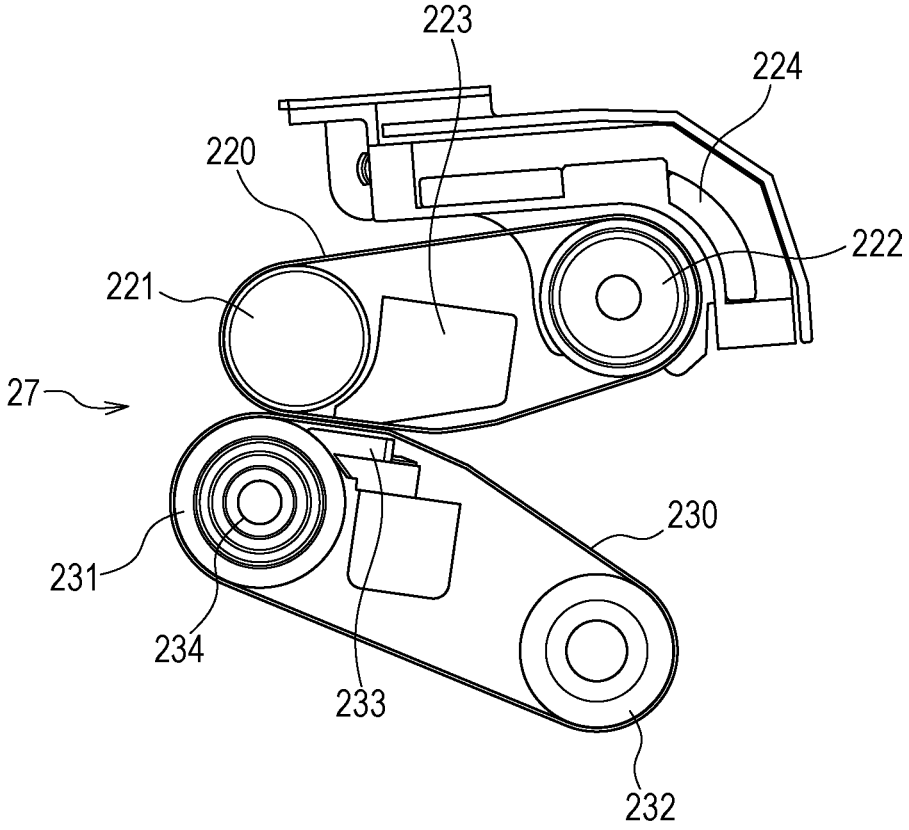
FIG. 2 is a cross-sectional view of a fixing apparatus provided in the image forming apparatus.
Figure 3A:
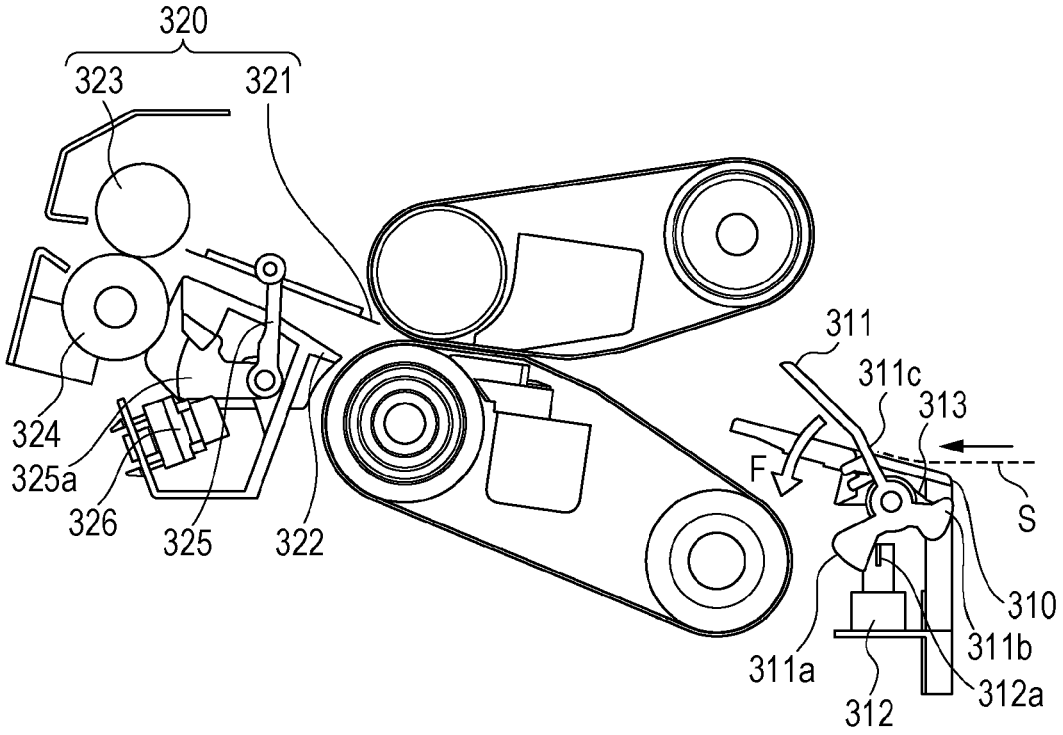
FIGS. 3A and 3B are drawings for explaining a configuration of a portion in the vicinity of the fixing apparatus.
Figure 3B:
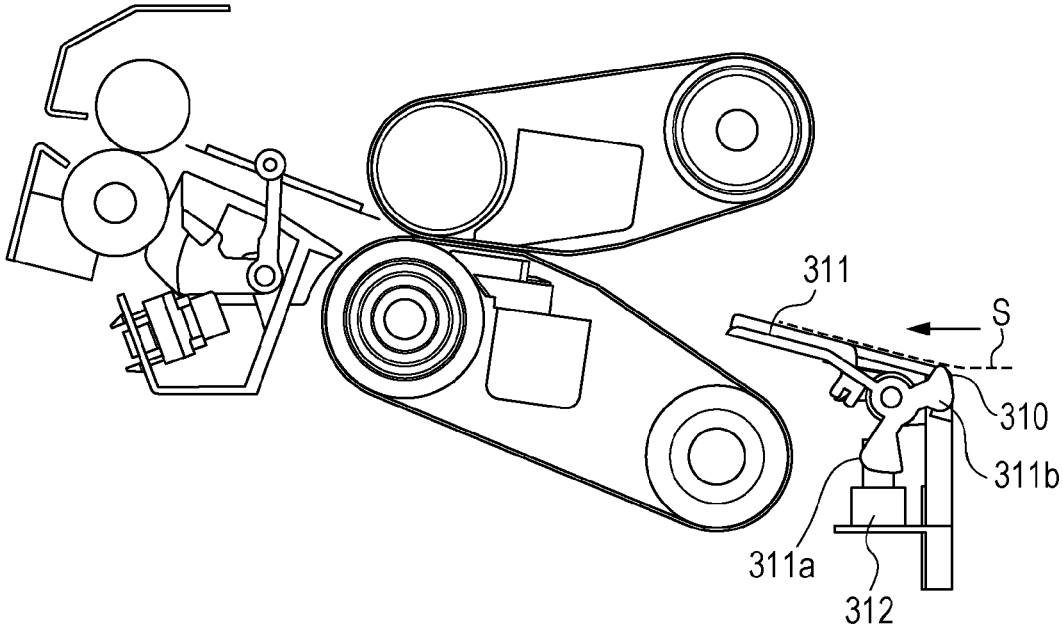
Figure 4:
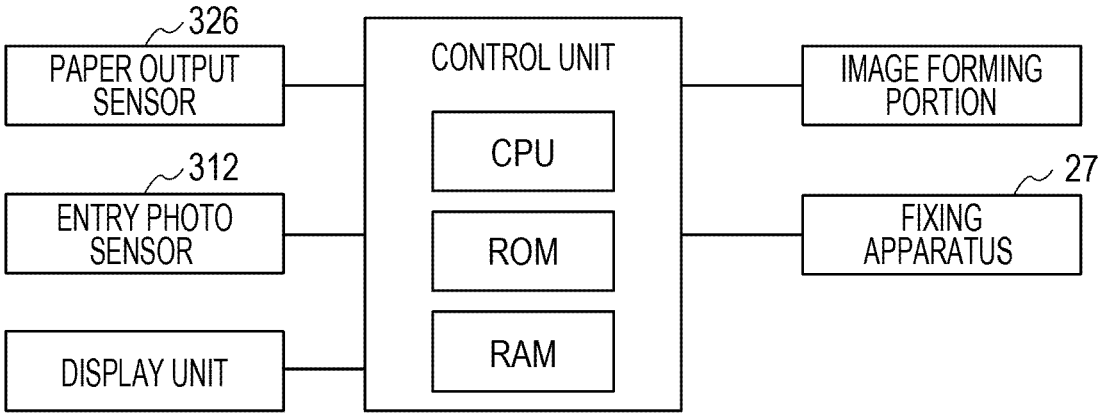
FIG. 4 is a control block diagram showing control to be performed when a jam occurs according to the embodiment.

Referring now to FIGS. 2-4, configurations and operations of the fixing apparatus 27 and the periphery of the fixing apparatus 27 will be described.

The fixing apparatus 27 includes a fixing belt 220 and a pressing belt 230 as a pair of fixing rotating bodies (a pair of rotating belts) for fixing the transferred toner image to the recording material. The fixing belt 220 and the pressing belt 230 have a configuration in which each belt is stretched over rollers, and respective members as shown below are arranged inside the respective belts.

The fixing belt 220 which is a principal part of a heating member is formed into an endless shape, and the fixing belt 220 is entrained about a fixing roller 221 and a fixing tension roller 222 and rotates. The fixing belt 220 can be selected as appropriate as long as it is caused to generate heat by a conduction heating coil 224 and has heat-resistant properties. For example, the fixing belt 220 may be formed by coating silicon rubber having a thickness of 500 μm for example on a magnetic metal layer such as a nickel metal layer or a stainless layer having a thickness of 100 μm, a width of 380 mm, and a circumference length of 200 mm, and covering the coated metal layer with a PFA (perfluoro-alkoxyfluoro plastics) tube as a surface layer. Magnetic lines of force are generated around the coil and an eddy current is generated on the metal layer of the fixing belt 220 by the passage of an alternating current through the conduction heating coil 224. This current is changed into Joule heat by a resistance of the metal layer, and hence the metal layer generates heat, whereby the fixing belt 220 is heated.

In the interior of the fixing belt 220, a temperature detecting unit (for example, a thermistor), not shown, is disposed, and detects the temperature of an inner surface of the fixing belt 220 on the basis of an output signal from the termistor. The temperature of the inner surface of the fixing belt 220 is heat-controlled to be, for example, 180° C.

The fixing roller 221 is manufactured by integrally molding a heat-resistant silicon rubber resilient layer on the surface layer of a core metal of, for example, stainless solid material having an outer diameter of ϕ 19. The fixing roller 221 is arranged on an exit side of a fixing nip portion between the fixing belt 220 and the pressing belt 230, and is distorted by a resilient deformation of the rubber resilient layer on the surface thereof by press contact with a pressing roller 231. The fixing tension roller 222 is configured to apply a tension set, for example, to 120 N in order to maintain the tension of the fixing belt 220 at an optimal level.

Also, a fixing pad stay 223 is provided inside the fixing belt 220 on an entry side of the area of the fixing nip portion between the pressing belt 230 and the fixing belt 220, that is, on the upstream side of the fixing roller 221. The fixing pad stay 223 is formed of, for example, stainless steel. The fixing pad stay 223 defines the nip portion together with a pressing pad 233, the fixing roller 221, and the pressing roller 231.

The pressing belt 230 which is a principal part of a pressing member is formed into an endless shape, and the pressing belt 230 is stretched over the pressing roller 231 and a pressing tension roller 232 and rotates.

The pressing tension roller 232 functions as a roller applying a moderate tension to the pressing belt 230. A heater 234 as a heating element is mounted in the interior of the pressing roller 231 so as to heat the pressing belt 230. The heater 234 employed in the invention is a halogen heater for example, but other heat sources may also be employed as long as they can be used as a heat source.

A temperature detecting unit (for example, a thermistor), not shown, is in abutment with an outer peripheral surface of the pressing belt 230 in an area out of the image area. The temperature of the outer peripheral surface of the pressing belt 230 is detected on the basis of the output signal from the termistor of the pressing belt 230 and the surface temperature of the pressing belt is heat-controlled to be, for example, 100° C.

The pressing pad 233 is provided on the entry side of the area of the fixing nip portion formed between the pressing belt 230 and the fixing belt 220, that is, inside the pressing belt 230 corresponding to the upstream side of the pressing roller 231 and, is formed of, for example, silicon rubber.

Referring now to FIGS. 3A and 3B, a configuration in the vicinity of the fixing apparatus 27 will be described. The fixing apparatus 27 includes an entry guide 310 so as to allow easy introduction of the recording material S indicated by a broken line into the nip portion of the fixing apparatus 27. The entry guide 310 is provided with a sheet detecting mechanism including an entry sensor lever 311 and an entry photo sensor 312 in order to detect whether the recording material has been conveyed thereto.

The entry sensor lever 311 as a rotating member is rotatable about the rotation shaft and is urged clockwise by a lever spring 313. In the normal state, the entry sensor lever 311 waits at a waiting position shown in FIG. 3A under the operation of the lever spring 313. When the entry sensor lever 311 is at the waiting position, a first abutting portion 311*c* of the entry sensor lever 311, which comes into contact with a leading edge of the recording material, projects upward from the entry guide 310, that is, into a conveying path in which the recording material is conveyed.

The entry sensor lever 311 is provided with a light-shielding portion 311*a* which turns the entry photo sensor 312 as a detecting sensor ON and OFF. In other words, the entry photo sensor 312 is configured to output signals corresponding to the positions of the entry sensor lever 311. The entry sensor lever 311 is formed with a second abutting portion 311*b* which comes into contact with a back side of the conveyed recording material so as to project radially from the rotation shaft. The second abutting portion 311*b* is formed on the side opposite from the first abutting portion 311*c* via the rotation shaft of the entry sensor lever 311. When the entry sensor lever 311 rotates counterclockwise, the second abutting portion 311*b* is formed to project upward from the entry guide 310, that is, into the conveying path in which the recording material is conveyed. The function of the second abutting portion 311*b* which comes into contact with the back side of the recording material will be described in detail later.

When the leading edge of the conveyed recording material S comes into abutment with the first abutting portion 311*c* of the entry sensor lever, the entry sensor lever 311 receives a rotational force about the rotation shaft, and hence rotates in the direction indicated by an arrow F in FIG. 3A. Then, the light-shielding portion 311*a* of the entry sensor lever 311 passes through the light receiving portion 312*a* provided on the entry photo sensor 312, and the state of the entry photo sensor 312 as the detecting sensor is changed from "transmitting" to "light-shielded", so that reaching of the recording material (the presence of the recording material) can be detected (see FIG. 3B).

The lever spring 313 holds the entry sensor lever 311 in the waiting state with a force smaller than the urging force applied to the entry sensor lever 311 by the recording material, so that the entry sensor lever 311 does not return to the waiting position when the recording material is positioned on the entry sensor lever 311. When a trailing edge of the recording material S passes on the upper portion of the entry sensor lever 311, the entry sensor lever 311 returns back to the waiting position again by the urging force of the lever spring 313.

The conveyed recording material S is conveyed along a guide surface of the entry guide 310 and enters the nip portion of the fixing apparatus 27. When the recording material is nipped at the nip portion, unfixed toner is sufficiently melted by heat and pressure and gets into fibers of the recording material, so that the toner is fixed on the recording material. The recording material receives rotating forces of the fixing belt 220 and the pressing belt 230, and is conveyed into an after-fixation paper output unit 320.

The after-fixation paper output unit 320 is provided with a separation sheet metal 321 as a separating unit, and the separation sheet metal 321 is arranged so as to be in proximity with the fixing belt 220 with a narrow clearance therebetween. The separation sheet metal 321 is formed of stainless steel and has a thickness on the order of 0.2 mm. As the separating unit configured to separate the recording material from the fixing belt 220, a non-contact separation-pawl type and a contact-type separation member may be used in addition to the non-contact type sheet metal in this embodiment.

A paper output guide 322 is disposed below the separation sheet metal 321. A pair of paper output rollers, namely, a paper output upper roller 323 and a paper output lower roller 324 are provided on the downstream side of the paper output guide 322 in the direction of conveyance. The paper output upper roller 323 and the paper output lower roller 324 convey the recording material separated from the fixing belt 220 by the separation sheet metal 321 in the direction of paper output.

When the recording material is conveyed to the after-fixation paper output unit 320, the recording material passes through a space below the separation sheet metal 321 and above the paper output guide 322, and is output. The paper output guide 322 includes a paper output sensor lever 325 substantially center in the longitudinal direction and a paper output sensor 326 below the paper output sensor lever 325. When the leading edge of the recording material hits against the paper output sensor lever 325, the paper output sensor lever 325 is rotated. When the state of the paper output sensor 326 is changed from "transmitting" to "light-shielded" by a light-shielding portion 325*a* of the paper output sensor lever 325, the arrival of the recording material is detected.

FIG. 4 is a control block diagram of the image forming apparatus. A central processing unit (CPU) as a control unit receives signals from the paper output sensor 326 and the entry photo sensor 312. The CPU controls operations of the fixing apparatus 27 and respective members of the image forming apparatus. The CPU also controls display on an operating panel.

Subsequently, a jam (paper jam) which may occur in a section from the fixing apparatus 27 to the after-fixation paper output unit 320 and an operation (control) of the image forming apparatus when the jam occurs will be described.

The nip portion of the fixing apparatus 27 needs to provide a large amount of heat in order to melt the unfixed toner transferred to the recording material sufficiently. However, when the toner is brought into a molten state, the viscosity of the toner is increased, and hence the toner serves as an adhesive agent between the fixing belt and the recording material. Therefore, a phenomenon in which even after the leading edge of the recording material has left the fixing nip, the recording material is not separated by the separation sheet metal 321 but twists around the fixing belt 220 may occur. When such a phenomenon occurs, the paper output sensor 326 of the after-fixation paper output unit 320 cannot detect the arrival of the recording material, so that the CPU determines this state as the paper jam. In the description given below, the state in which the recording paper twists around the fixing belt 220 is referred to as a twist-around jam.

When a twist-around jam occurs, the recording paper twists uniformly around the surface of the fixing belt. Therefore, detectability of the remaining recording materials is low. If there is any recording material which is not cleared after other jammed recording materials are cleared, when the image forming apparatus is restored and the fixing apparatus restarts its rotation, the recording material still further twists around the fixing belt, and breakdown of the fixing apparatus may result. Therefore, provision of a unit configured to detect the remaining sheet for a case where clearing of the twist-around jam has been forgotten is effective. In this embodiment, the CPU determines the presence or absence of the remaining sheet on the basis of signals from the entry photo sensor 312.

Figure 5A:
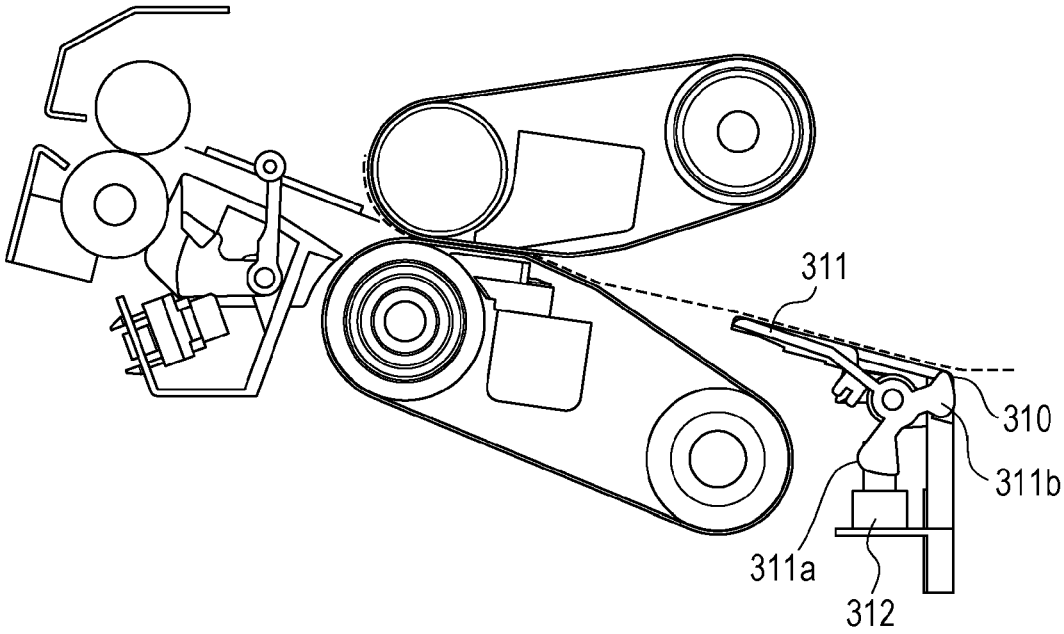
FIGS. 5A and 5B are drawings showing a twist-around jam.

Incidentally, FIG. 5A shows a state of conveyance of the recording material at a moment when the CPU determines that the twist-around jam occurs. When the CPU determines that the twist-around jam occurs, the CPU sends a stop signal to a drive source, not shown, which drives a fixing gear.

Figure 5B:
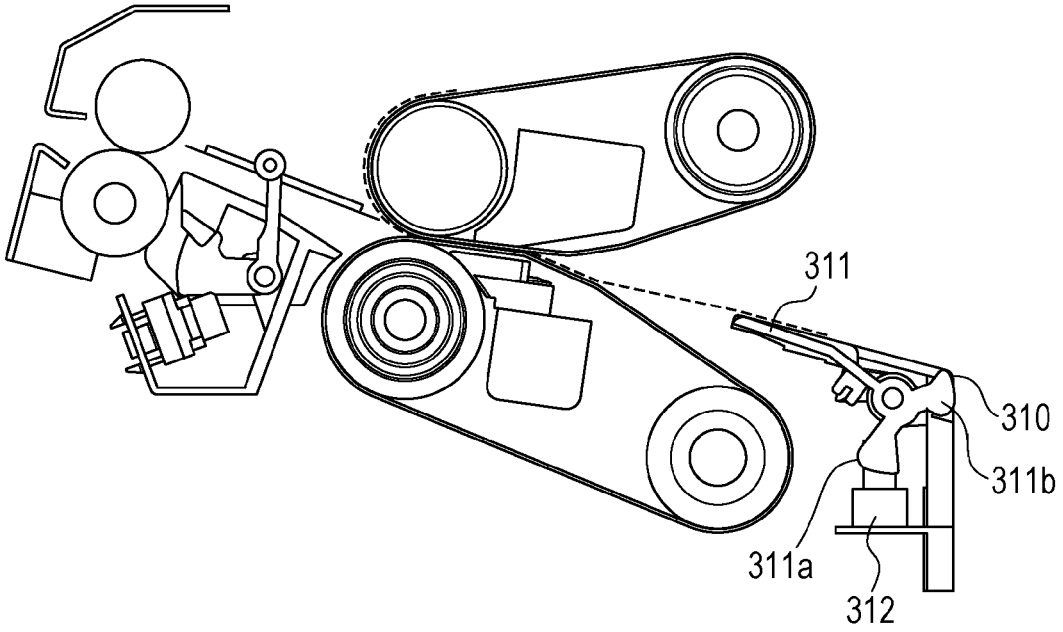

Since there is rotational inertia in the drive source and the fixing apparatus, conveyance of the recording material by the fixing apparatus is continued until the rotation of the fixing apparatus is completely stopped after the CPU has actually sent the stop signal. A state of conveyance of the recording material when the recording material is actually stopped is shown in FIG. 5B. At this time, when the trailing edge of the recording material exists on the upstream side of a portion above the entry sensor lever 311 in the direction of conveyance, it can be determined to be a fixation twist-around jam on the basis of a combination of signals. In other words, after the apparatus has stopped because of the occurrence of the jam, if the combination of the states is such that the paper output sensor 326 is in the "transmitting" state (the recording material is not present) and the entry photo sensor 312 is in the "light-shielded" state (the recording material is present), the fact that the twist-around jam has occurred can be detected. Here, the entry photo sensor 312 also is in the light-shielded state (the recording material is present) when a user forgets to clear the jammed sheet, the CPU can detect the fact that there is a remaining sheet which has yet to be cleared and can notify the user the fact that the jam has not been cleared yet.

Figure 6:
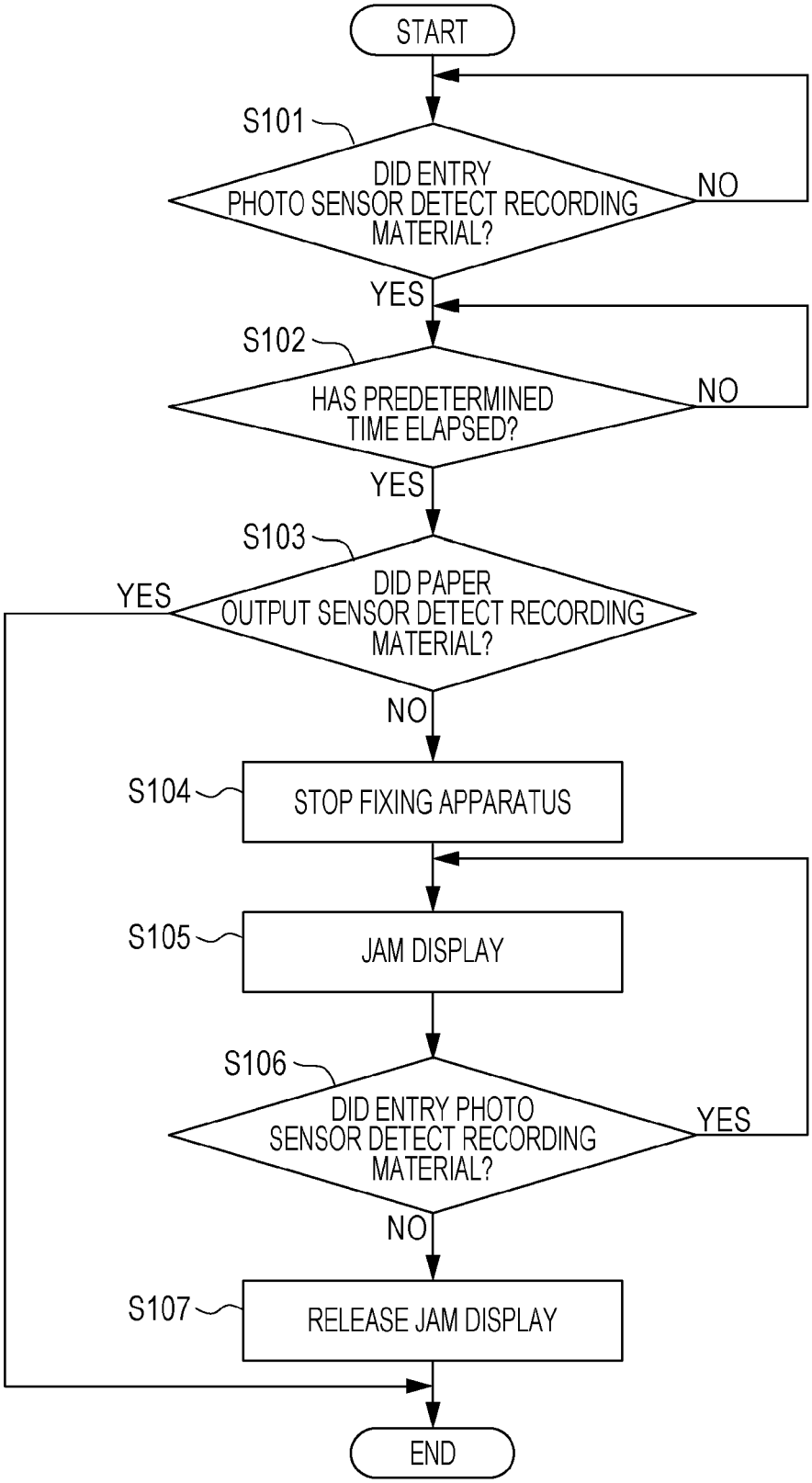
FIG. 6 is a flowchart showing control to be performed when the jam occurs according to the embodiment.

The operations to be taken at the time of occurrence of the jam described above will be described with reference to a flowchart shown in FIG. 6. The CPU determines whether or not the entry photo sensor 312 has detected the conveyed recording material (S101). If the entry photo sensor 312 has detected the conveyed recording material (YES in S101), the CPU determines whether a predetermined time has elapsed since the detection of the recording material by the entry photo sensor 312 (S102). After the predetermined time has elapsed, the CPU determines whether or not the paper output sensor 326 detects the recording material (S103).

If the paper output sensor 326 has not detected the recording material after the predetermined time (NO in S103), the CPU determines that it is a delay jam. Then, the CPU stops the operation of the fixing apparatus (S104), and causes a display unit to perform a display which notifies the user the fact that the recording material has become jammed, or which prompts the user to remove the jammed recording material (jam display) (S105). The CPU determines whether or not the entry photo sensor 312 detects the recording material (S106), and causes the display unit to perform the jam display until the entry photo sensor 312 does not detect the recording material any longer. When the entry photo sensor 312 does not detect the recording material any longer, the CPU cancels the jam display (S107).

Subsequently, the operation of the entry sensor lever 311 according to this embodiment will be described in detail with reference to FIGS. 3A and 3B.

As described above, the entry sensor lever 311 is provided with the second abutting portion 311*b* which abuts against the recording material. When the recording material is conveyed, the leading edge of the recording material comes into contact with the first abutting portion 311*c* of the entry sensor lever 311, and the conveyed recording material provides the entry sensor lever 311 with a force in the direction indicated by the arrow F in FIG. 3A. Then, the entry sensor lever 311 rotates in the direction indicated by the arrow F, and the second abutting portion 311*b* of the entry sensor lever 311 abuts against the back side of the recording material (see FIG. 3B). The rotation of the entry sensor lever 311 in the direction F is restricted by the abutment of the second abutting portion 311*b* of the entry sensor lever 311 with the recording material. In other words, the rotational operation of the entry sensor lever 311 in the direction F (the direction of rotation caused by being pushed by the conveyed recording material) is restricted by the abutment of the second abutting portion 311*b* of the entry sensor lever 311 with the recording material. Since the rotation of the entry sensor lever 311 in the direction F is restricted by being pressed by the leading edge of the recording material, the entry sensor lever 311 is prevented from excessively rotating and coming into abutment with the pressing belt 230.

Figure 7:
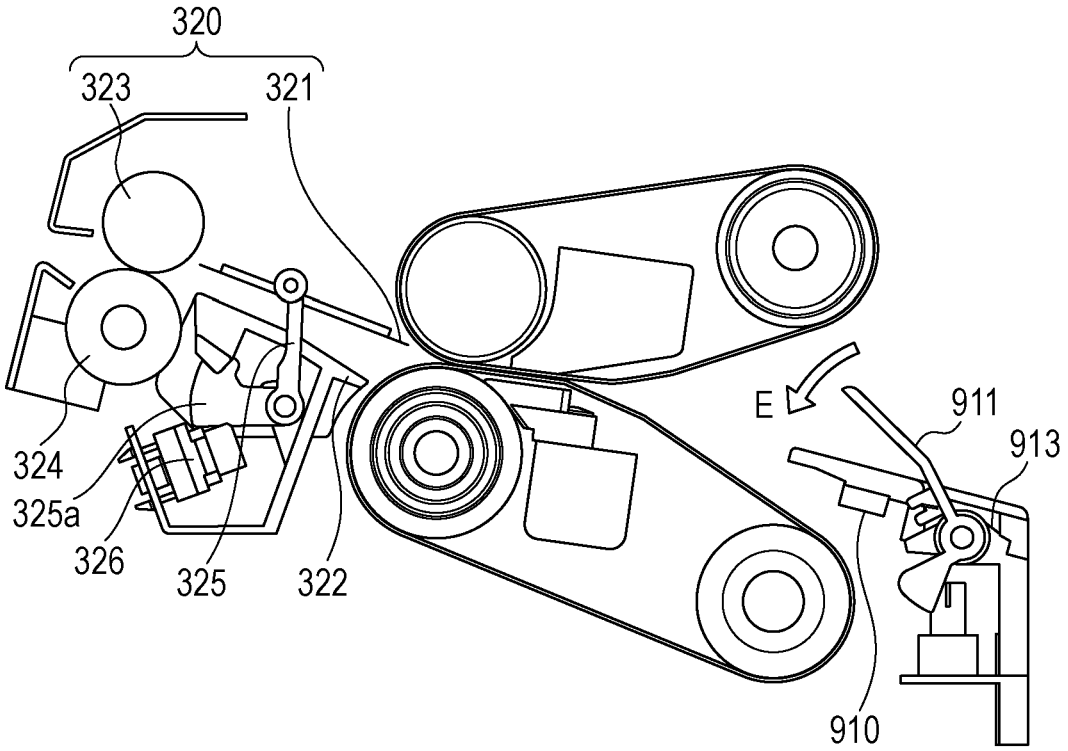
FIG. 7 is an explanatory drawing showing Comparative Example 1.

Referring now to FIG. 7, as a configuration of the sensor lever, a configuration in which a stopper which restricts the rotation of the sensor lever which is rotated by being pressed by the recording material is provided will be described as Comparative Example 1.

In Comparative Example 1 shown in FIG. 7, a sensor lever 911 continues to rotate in the direction indicated by an arrow E by being pushed by the leading edge of the recording material, and comes into abutment with a stopper 910 provided on a conveyance guide, whereby further rotation of the sensor lever 911 in the direction indicated by the arrow E is restricted. Since a reaction force acts on the sensor lever 911 which abuts against the stopper 910, the sensor lever 911 rotates in the direction opposite from the direction of rotation indicated by the arrow E in FIG. 7. The sensor lever 911 is urged clockwise by a spring 913. In a state in which the clockwise rotation is restricted by the contact of a distal end of the sensor lever 911 with the back side of the recording material, the recording material is conveyed.

In a configuration of Comparative Example 1, there is a problem of generation of an impact noise when the sensor lever 911 comes into abutment with the stopper 910. In addition, in the configuration of Comparative Example 1, a problem of rotation failure of the sensor lever 911 may occur as described below.

The fixing apparatus 27, especially the fixing belt 220 and the pressing belt 230 are maintained at a high temperature for melting the toner. When the toner is melted at the nip portion of the fixing apparatus, a mold release agent dispersed among toner particles vaporizes and hence assumes a state of being vaporized in an atmosphere in the fixing apparatus. The components positioned away from the nip portion of the fixing apparatus 27 are low in temperature in comparison with the fixing belt 220 or the pressing belt 230. Therefore, when the vaporized mold release agent comes into touch therewith, the component of the mold release agent having viscosity is re-solidified, and is gradually accumulated on those components. In other words, the stopper 910 of the sensor lever 911 is under an environment in which the component of the mold release agent adheres easily thereto. For reference sake, an urging force applied by the lever spring to the entry sensor lever of the fixing apparatus 27 is needed to be minimized so as not to hinder the conveyance properties of thin paper having a light basis weight and to allow detection of the remaining sheets.

When the number of sheets to be passed through is increased, the component of the mold release agent is accumulated on the sensor lever 911 and the stopper 910. In Comparative Example 1, when the component of the mold release agent is accumulated on the stopper 910 of the sensor lever 911, failure of rotation of the sensor lever 911 may occur. In other words, when the sensor lever 911 comes into abutment with the stopper 910 in a state in which the component of the mold release agent is attached to the sensor lever 911 or the stopper 910, the component of the mold release agent having viscosity acts as an adhesive agent which adheres the sensor lever 911 with the stopper 910. When the component of the mold release agent having viscosity acts as the adhesive agent which adheres the sensor lever 911 with the stopper 910, the sensor lever 911 cannot be separated from the stopper 910, and hence the sensor lever 911 does not return to the waiting position. In Comparative Example 1 shown in FIGS. 5A and 5B, the component of the mold release agent works as the adhesive agent between the sensor lever 911 and the stopper 910, and the entry sensor lever 311 cannot be returned to the waiting position by the urging force of the lever spring 313 and the reaction force generated when the sensor lever 911 comes into abutment with the stopper 910. If the sensor lever 911 does not return to the waiting position, erroneous detection of the recording material may be resulted.

In contrast, in the embodiment of the invention shown in FIGS. 3A and 3B, the rotation of the entry sensor lever 311 in the direction of rotation, which is caused when pushed by the leading edge of the recording material, is restricted by the contact of the second abutting portion 311*b* with the conveyed recording material. In the embodiment of the invention shown in FIG. 3A and 3B, generation of a noise in association with the stop of rotation of the entry sensor lever 311 is reduced in comparison with the mode shown in FIG. 7 in which the lever is stopped by the stopper 910. The reason why the generation of the noise is reduced is because the hardness of the recording material is lower than the hardness of resin (or metallic member) used as the stopper 910 in Comparative Example 1. Also, since the member which hinders the rotation of the entry sensor lever 311 is not a member fixed to a position in the vicinity of the nip portion of the fixing apparatus like the stopper in Comparative Example 1, accumulation of the mold release agent does not occur, and hence the probability of occurrence of the operation failure is reduced.

In Comparative Example 1 shown in FIG. 7, a phenomenon in which the sensor lever 911 repeats minute reciprocal movement when the sensor lever 911 comes into contact with the stopper 910, which is so-called chattering, may occur. When the chattering is generated, ON and OFF operation of the sensor is repeated in a micro time, and hence erroneous detection may easily be resulted.

Figure 8A:
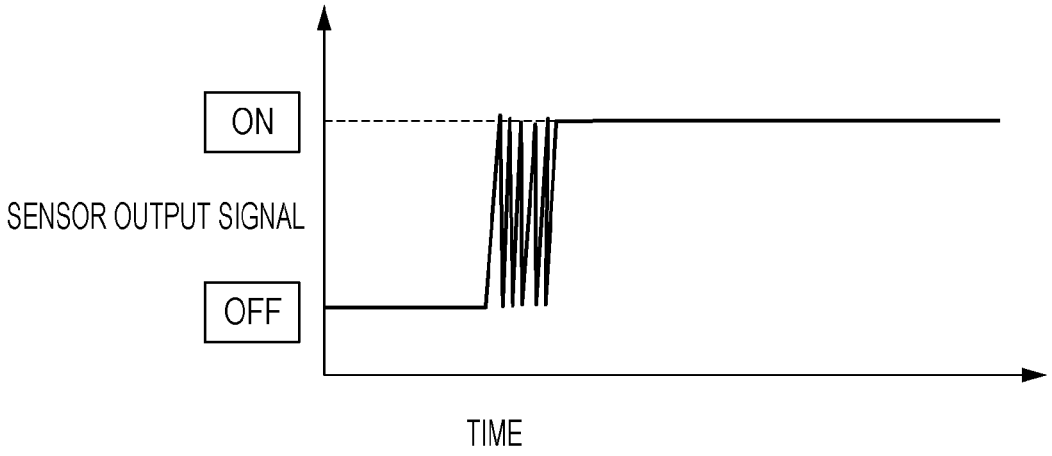
FIGS. 8A and 8B are explanatory drawings for comparing sensor outputs between Comparative Example 1 and the embodiment.
Figure 8B:
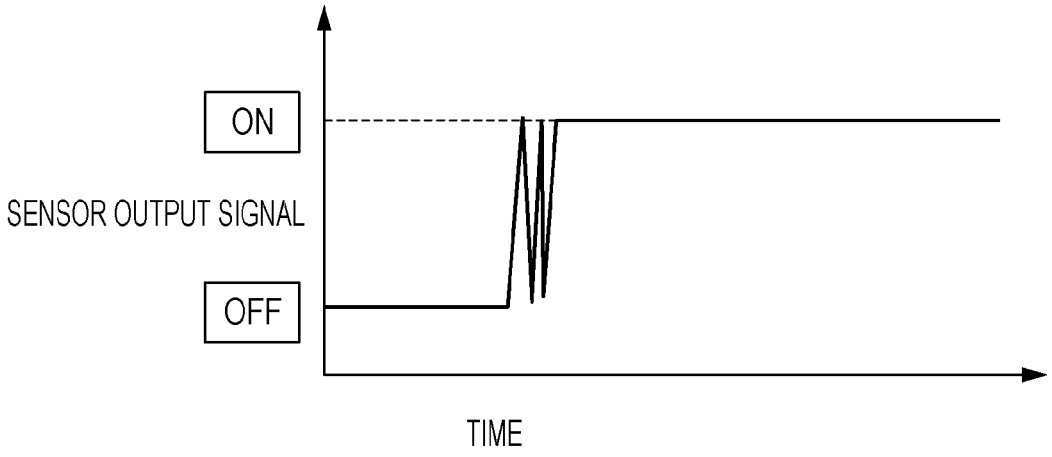

In contrast, in the embodiment of the invention shown in FIGS. 3A and 3B, the rotation of the entry sensor lever 311 in the direction of rotation, which is caused when pushed by the leading edge of the recording material is restricted. The hardness of the recording material is lower than the hardness of the resin (or the metallic member) used as the stopper 910 in Comparative Example 1. Therefore, spring back of the entry sensor lever 311 after having come into abutment with the recording material is reduced. Therefore, repeated switching between ON and OFF of the signal from the detection sensor in a micro time due to the chattering is reduced. FIG. 8A shows an output signal from a sensor in a case where the sensor lever is brought into abutment with resin of Comparative Example 1, and FIG. 8B shows a state of an output signal from the detecting sensor of the sheet detecting mechanism in this embodiment shown in FIGS. 3A and 3B.

As a detecting unit for detecting the recording material, there is a method in which a non-contact type optical sensor is used instead of a system using the lever. However, in the case of employing the optical sensor system, the working temperature in the vicinity of the fixing apparatus may become a problem. In general, since the usage of the optical sensor in the high-temperature atmosphere is difficult, a countermeasure for blocking heat from being transferred from the fixing apparatus to the optical sensor is desirable, which may result in cost increase. In addition, the optical sensor has a possibility of erroneous detection due to the blockage of an optical path by paper powder or the like.

Also, when the rotary lever is configured not to be restricted from rotating in the direction of rotation when being pushed by the recording material, the lever may rotate excessively by the inertia when the lever is pushed by the recording material and hence other devices may become damaged by the lever. For example, when the lever is rotated by being pushed by the recording material, the lever may come into abutment with the fixing apparatus (for example, the pressing belt) and cause damage to the surface layer thereof.

Figure 9A:
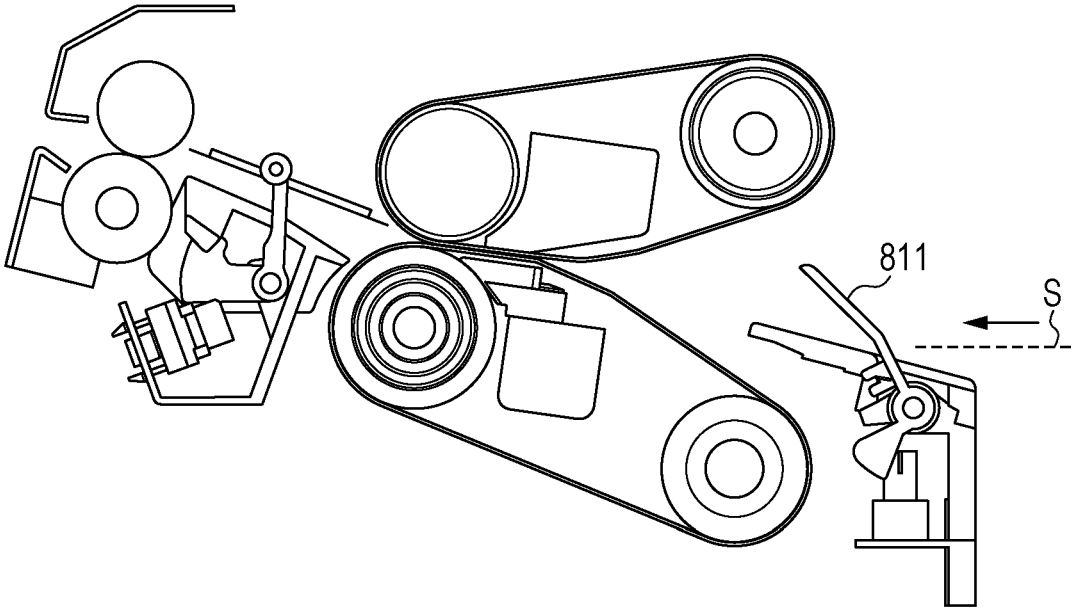
FIGS. 9A and 9B are explanatory drawings showing Comparative Example 2.
Figure 9B:
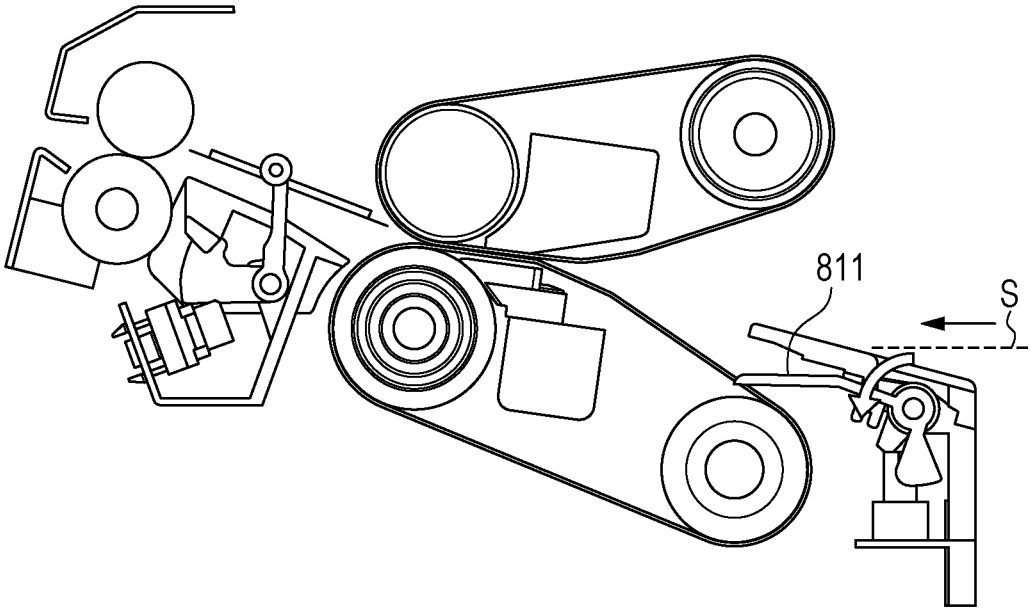

FIGS. 9A and 9B show a configuration of Comparative Example 2 having a lever 811 whose rotation is not restricted in a manner described above. When the sensor lever 811 is rotated, the lever 811 tries to return only by an urging force of the spring. However, since the urging force of a lever spring 813 is set to have a very small resilient force as described above, the rotation cannot be stopped immediately. Then, as shown in FIG. 9B, when the recording material comes into abutment with the entry sensor lever 811, the lever 811 may collide against the belt of the fixing apparatus located in the course of rotation and cause damage to the belt surface.

In order to detect whether or not the recording material stopped by the twist-around jam remains in the apparatus, the recording material stopped on the upstream side of the nip portion of the fixing apparatus 27 in the vicinity of the nip portion needs to be detected. The reason is that if the trailing edge of the recording material stops at a position passed through the entry sensor lever, the entry sensor lever cannot detect the stopped recording material. Therefore, in order to detect the remaining sheet, it is necessary to arrange the entry sensor lever 311 in the vicinity of the fixing nip and, consequently, the entry sensor lever 311 is susceptible to collision with the pressing belt 230. When speeding up of the image forming apparatus is advanced, the rotational inertia of the drive source or the fixing apparatus after having recognized the occurrence of a jam become larger correspondingly. Therefore, the amount of conveyance of the recording material until the rotation of the fixing apparatus is completely stopped since the CPU sends the stop signal is increased. Therefore, the necessity to dispose the entry sensor lever 311 at a position closer to the fixing nip is increased as the speed of the image forming apparatus increases.

In the embodiment, description has been given relating to the sensor lever used in the fixing apparatus. However, the invention is not limited to the sensor lever provided in the vicinity of the fixing apparatus, but may be applied to any sensor levers which detect the reaching of the recording material in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-293016 filed Dec. 28, 2010, which is hereby incorporated by reference herein in its entirety.

What is claimed is:

1. A sheet conveying apparatus comprising:

a rotating member having a first abutting portion with which a leading edge of a sheet being conveyed comes into contact and rotating in a first rotating direction from a waiting position by being pushed by the leading edge of the sheet being conveyed;

a biasing portion configured to bias the rotating member to be located in the waiting position, wherein the rotating member rotates in a second direction opposite to the first direction to the waiting position by a biasing force of the biasing portion after a trailing edge of the sheet passes the rotating member;

a sensor configured to output a signal corresponding to a position of the rotating member; and a second abutting portion provided on the rotating member on a side opposite from the first abutting portion with respect to a rotation shaft of the rotating member and configured to come into contact with the sheet being conveyed in the course of the rotation of the rotating member in the first direction by being pushed by the leading edge of the sheet being conveyed.

2. The sheet conveying apparatus according to claim 1, wherein the second abutting portion of the rotating member projects into a conveying path in which the sheet is conveyed and comes into contact with the sheet, in association with the rotation of the rotating member caused by being pushed by the leading edge of the sheet being conveyed.

3. The sheet conveying apparatus according to claim 1, further comprising a control unit configured to determine whether or not there is a remaining sheet based on a signal from the sensor.

4. An image forming apparatus comprising:

a sheet conveying apparatus configured to convey a sheet according to claim 1; and a fixing unit configured to fix an image on the sheet by nipping and conveying the sheet being conveyed by the sheet conveying apparatus at a nip portion, wherein the rotating member is arranged so as to come into contact with the sheet upstream of the nip portion.

5. The image forming apparatus according to claim 4, wherein the second abutting portion of the rotating member projects into a conveying path in which the sheet is conveyed and comes into contact with the sheet, in association with the rotation of the rotating member caused by being pushed by a leading edge of the sheet being conveyed.

6. The image forming apparatus according to claim 4, further comprising a control unit configured to determine whether or not there is a remaining sheet based on a signal from the sensor.

7. The image forming apparatus according to claim 4, wherein the nip portion of the fixing unit is formed by a pair of rotating belts.

8. The image forming apparatus according to claim 1, wherein the biasing portion is configured to bias the rotating member in the second direction at all time.

* * * * *